United States Patent [19]

Jodoin

[11] Patent Number: 4,674,239

[45] Date of Patent: Jun. 23, 1987

[54] PORTABLE ABRASIVE BLASTING GUN ASSEMBLY

[76] Inventor: Pierre-Paul Jodoin, 3734 rue Principale CP 297, Dunham, Quebec, Canada, J0E 1M0

[21] Appl. No.: 868,013

[22] Filed: May 29, 1986

[51] Int. Cl.[4] ..... B24C 5/02

[52] U.S. Cl. ..... 51/424; 51/427; 51/410

[58] Field of Search ..... 51/410, 427, 424, 319, 51/439

[56] References Cited

U.S. PATENT DOCUMENTS 2,503,743 4/1950 Keefer ..... 51/439
3,624,966 12/1971 Palmer ..... 51/427

FOREIGN PATENT DOCUMENTS 2537033 6/1984 France ..... 51/427

*Primary Examiner*—Frederick R. Schmidt
*Assistant Examiner*—Robert A. Rose

[57] ABSTRACT

An improved portable abrasive blasting gun assembly which comprises a gun part having a compressed air conduit and an abrasive material conduit intersecting with one another to produce an abrasive carrying air jet. A protective housing is detachably secured to the gun. The housing has an abrasive blasting orifice and a vacuum conduit in a side wall of the housing for removal of abrasive particles from the housing. The improvement in the assembly comprises an adapter barrel for interconnecting the gun part to the protective housing and permitting angular displacement of said abrasive carrying air jet along a predetermined plane. The barrel has a straight conduit therein and a gun securing portion to removably secure same to the gun. The barrel also has a nozzle end portion and a swivel connecting portion. The barrel is further received in a connecting aperture of the protective housing and retained on a pivot connection in the aperture of the housing with the nozzle end portion disposed forwardly of the vacuum conduit.

8 Claims, 3 Drawing Figures

PORTABLE ABRASIVE BLASTING GUN ASSEMBLY

BACKGROUND OF INVENTION

1. Field of the Invention

The present invention relates to an improved portable abrasive blasting gun assembly, and particularly, but not exclusively, to a blasting gun assembly for use in abrading a code provided in a stencil which is positioned against a surface to be abraded, such as glass or metal.

2. Description of Prior Art

In the prior art, there is known the construction of a similar apparatus such as shown and described in U.S. Pat. No. 4,048,918 issued on Sept. 20, 1977. However, this apparatus is bulky, difficult to assemble, and does not utilize conventional abrasive material guns. It also has a unitary purpose and that is for sandblasting information provided in a stencil which is adapted to a stencil holding unit which is fixed at the end of the gun.

SUMMARY OF INVENTION

It is a feature of the present invention to provide an adapter barrel for interconnecting a conventional abrasive blasting gun to a protective vacuum housing and wherein the barrel is easy to install to both parts and permits angular displacement of the abrasive carrying air jet along a predetermined plane.

Another feature of the present invention is to provide an improved portable abrasive blasting gun assembly which is easy to assemble, easy to repair, and economical to fabricate.

Another feature of the present invention is to provide an adapter barrel for converting an existing sandblasting gun unit into a stencilling apparatus.

According to the above features, from a broad aspect, the present invention provides an improved portable abrasive blasting gun assembly which comprises a gun part having a compressed air conduit and an abrasive material conduit intersecting with one another to produce an abrasive carrying air jet. A protective housing is detachably secured to the gun. The housing has an abrasive blasting orifice and a vacuum conduit in a side wall of the housing for removal of abrasive particles from the housing. The improvement in the assembly comprises a unitary adapter barrel for interconnecting the gun part to the protective housing and permitting angular displacement of said abrasive carrying air jet along a predetermined plane. The barrel has a straight conduit therein and a gun securing portion to removably secure same to the gun. The barrel also has a nozzle end portion and a swivel connecting portion. The straight conduit, the gun receiving portion, the nozzle end and the swivel connecting portion are integrally formed with the adaptor barrel. The barrel is received in a connecting aperture of the protective housing. The barrel is connected in the connecting aperture by a pair of opposed pivot pins extending into the conduit aperture with the barrel spaced from a circumferential wall of the aperture for limited pivotal displacement therein. The pivot pins are retained in opposed threaded bores in the circumferential wall of the connecting aperture and extend therethrough. The connecting aperture communicates the vacuum housing with outside atmosphere through a circumferential space about the adaptor barrel. The nozzle end portion also lies forwadly of the vacuum conduit.

BRIEF DESCRIPTION OF DRAWINGS

A preferred embodiment of the present invention will now be described with reference to an example thereof as illustrated in the accompanying drawings in which.

DESCRIPTION OF PREFERRED EMBODIMENTS

Figure 1:
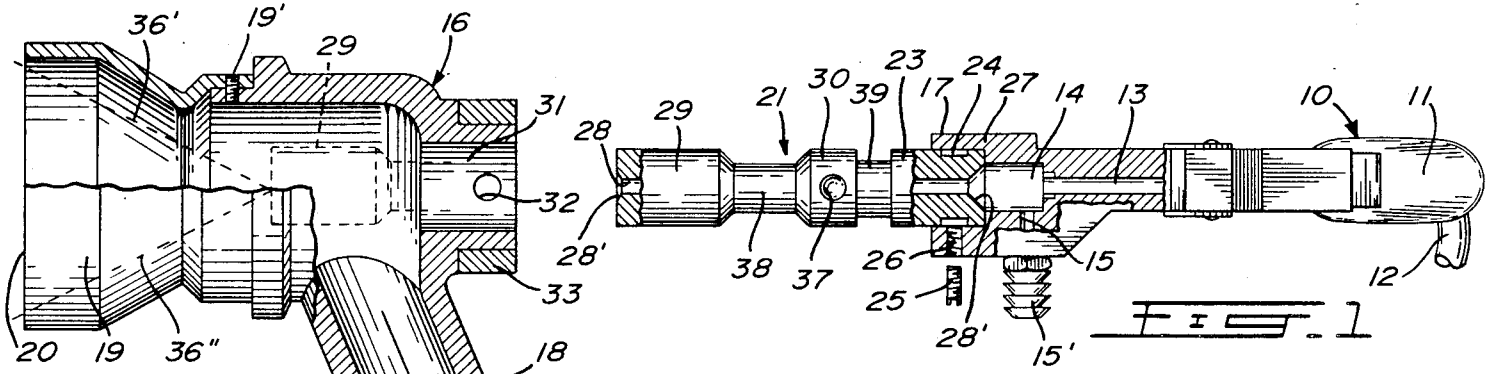
FIG. 1 is a side view, partly fragmented, showing an abrasive blasting gun having the adapter barrel of the present invention secured thereto.

Referring to the drawings, there is shown at 10, a standard abrasive blasting gun which comprises a gun handle 11 to which there is connected a flexible tube 12 for conducting air under pressure into a compressed air conduit 13 where air is mixed with an abrasive material such as sand particles which are sucked in to the air conduit in an intersecting or mixing chamber 14 where the abrasive material conduit 15 intersects the conduit 13. A coupling 15' connects a flexible tube to a supply of abrasive material.

When it is necessary to sandblast a specific enclosed area, such as stencilling apparatus, there is usually provided a protective vacuum housing 16 to which a nozzle end 17 of the gun 10 is secured. The protective housing has a vacuum conduit 18 connected thereto for removing abrasive material deposited within the housing 16 after the material has impinged on the surface to be blasted.

A hood coupling 19 is usually attached to the housing 16 to delineate the area that has to be sandblasted. However, with prior art apparatus, the mainstream of abrading particles is usually directed centrally of the hood orifice 20 and thus the ends of the peripheral regions of the hood orifice are not subjected to the same abrasion of the central portion. However, as herein shown, there is provided an adapter barrel 21 which permits a swivelling attachment of the gun part 10 to the protective vacuum housing 16 whereby the mainstream of the abrasive carrying air jet is directed all along an elongated rectangular orifice 20 which is provided in the hood coupling 19.

As can be seen from FIG. 1, an important feature of the portable abrasive blasting gun assembly as herein shown is the fact that the entire assembly is easily disassembled to provde a compact unit and this is done by simply removing approximately four fasteners. For example, the hood coupling 19 is attached to the vacuum housing 16 by a single or double securing threaded fasteners 19'. Also, the adapter barrel 21 connects to the vacuum housing 16 by means of two pivot pins 22 as will be described later. The adapter barrel 21 is also provided with a gun securing portion 23 having an annular securing channel 24 circumferentially thereof for securement by a retaining head portion of a threaded element 25 which is threaded in a bore 26 provided in an end cylinder connection portion 27 of the gun 10.

As shown in FIG. 1, the barrel 21 is a tempered steel barrel having a through bore 28 extending centrally longitudinally therethrough and having a circular cross-section. The bore terminates at opposed ends in a funnel-shaped cavity 28' whereby to reduce wear by the abrasive particles carried by the air jet and entering or leaving the adapter barrel. The barrel is further provided with a nozzle end portion 29 at the opposite end to the gun securing portion 23. Intermediate these two portions there is provided a swivel connecting portion 30 whereby to pivotally secure the gun part 10 to the protective vacuum housing 16.

Figure 3:
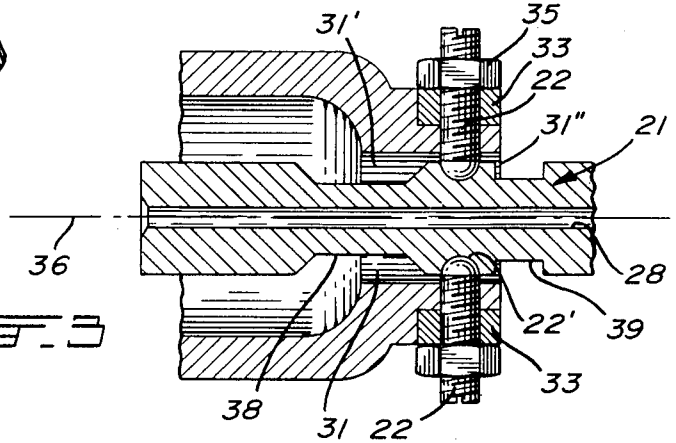
FIG. 3 is an enlarged fragmented section view of the swivel connection of the adapter barrel to the protective vacuum housing.
Figure 2:
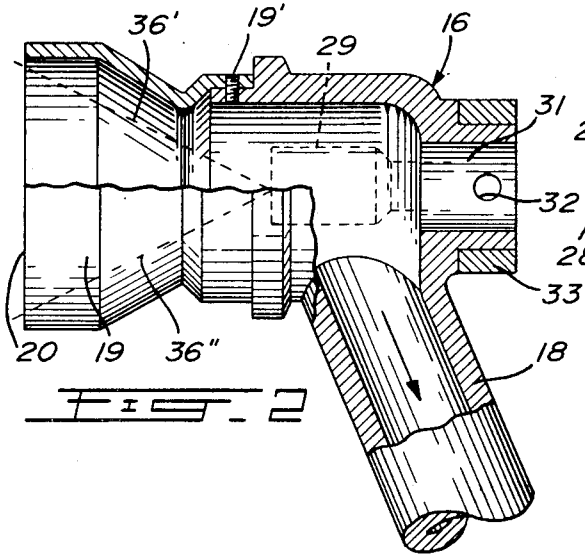
FIG. 2 is a fragmented, partly sectioned view of the protective vacuum housing securable to the gun.

As shown in FIG. 2, the protective vacuum housing 16 is provided with a connecting aperture 31 which is circular in cross-section whereby to receive the adapter barrel 21 therein. This barrel 21 is connected on a pivot connection provided in the aperture 31 and consisting of a pair of opposed pivot pins 21 threadably received in diametrically opposed threaded bores 32, as shown in FIG. 3. A rigid support ring 33 is also disposed about the connecting aperture 31 to maintain the pivot pins rigidly along a fixed pivot axis. This ring also provides for an adapter for existing vacuum housing 16 whereby to convert the assembly into a swivelling assembly, as above described.

As shown in FIG. 3, these pivot pins are elongated pins which project outwardly of the ring 33 whereby a lock nut 35 is received in the top portion of the pins to prevent axial rotation of the pins after they have been threaded to engage the adapter barrel 21 and located substantially centrally of the aperture 31. With this type of connection, the longitudinal axis 36 of the adapter barrel 21 may be displaced angularly along a fixed plane to span the entire blasting orifice 20 as indicated by the position of the axis at 36' and 36'' in FIG. 2. Also, as shown in FIG. 3, the pivot pins have a rounded pivot end 22' which are received in a respective one of support pin receiving cavities 37 diametrically disposed in the outer periphery of the connecting portion 30.

In order to permit the adapter barrel 21 to be displaced angularly along the plane, the barrel is provided with a reduced diameter barrel portion 38 and 39 to each side of the swivel connecting portion 30. This provides clearance with the outer circumferential edges 31' and 31'' of the connecting aperture 31 (see FIG. 3). The barrel is also of sufficient length whereby the nozzle end 29 is positioned forwardly of the vacuum conduit 18 whereby the abrasive jet is not affected by the suction force of the vacuum.

It can thus be seen that the adapter barrel and pivot pin assembly can adapt a standard sandblasting gun to a protective vacuum housing 16 whereby to render the gun displaceable on a swivel or pivot connection and this is done economically at the same time providing an assembly which is easy to assemble and disassemble thus facilitating transportation, storage, repair and maintenance of all of the parts of the assembly.

It is within the ambit of the present invention to cover any obvious modifications of the example of the preferred embodiment described herein provided such modifications fall within the scope of the appended claims.

I claim:

1. An improved portable abrasive blasting gun assembly comprising a gun part having a compressed air conduit and an abrasive material conduit intersecting said compressed air conduit to produce an abrasive carrying air jet, a protective vacuum housing detachably secured to said gun, said housing having an abrasive blasting orifice and a vacuum conduit in a side wall of said housing for the removal of abrasive particles from said housing, the improvement comprising a unitary adapter barrel for interconnecting said gun part to said protective housing and permitting angular displacement of said abrasive carrying air jet along a predetermined plane; said barrel having a straight conduit therein and a gun securing portion to removably secure same to said gun, a nozzle end portion and a swivel connecting portion, said straight conduit, said gun securing portion, said nozzle end portion and said swivel connecting portion being integrally formed; said barrel being received in a connecting aperture of said protective housing, said barrel being connected in said connecting aperture by a pair of opposed pivot pins extending into said connecting aperture with said barrel spaced from a circumferential wall of said aperture for limited pivotal displacement therein, said pivot pins being retained in opposed threaded bores in said circumferential wall of said connecting aperture and extending therethrough, said connecting aperture communicating said vacuum housing with outside atmosphere through a circumferential space about said adaptor barrel, said nozzle end portion lying forwardly of said vacuum conduit.

2. An abrasive blasting gun assembly as claimed in claim 1, wherein a support ring is further disposed on an outer circumferential wall of said connecting aperture, said pivot pins being elongated pins extending through said support ring, and arresting means secured to an outer end portion of each said pins exteriorly of said support ring.

3. An abrasive blasting gun assembly as claimed in claim 2, wherein said arresting means is a threaded nut disposed about said outer end portion.

4. An abrasive blasting gun assembly as claimed in claim 2, wherein each said threaded pivot pins have an internal rounded pivot end adapted to be received in a respective one of said support pin receiving cavities of said connecting portion of said adapter barrel.

5. An abrasive blasting gun assembly as claimed in claim 1, wherein said abrasive blasting orifice of said protective housing has a slot aperture configured to overlie a stencil having coded apertures therein whereby to abrade a code on a surface on which said stencil is disposed.

6. An abrasive blasting gun assembly as claimed in claim 5, wherein said pivot connection is oriented so that the longitudinal axis of said barrel when displaced along said plane will direct said abrasive carrying air jet entirely along said slot aperture.

7. An abrasive blasting gun assembly as claimed in claim 1, wherein said gun securing portion of said barrel is a cylinder portion having a circumferential channel adjacent a free end thereof for receiving therein a retaining head portion of a threaded element threadably secured in an end cylinder connecting portion of said gun.

8. An abrasive blasting gun assembly as claimed in claim 7, wherein said barrel is a tempered steel barrel having a through bore of circular cross-section, said bore terminating in funnel-shaped cavities at a respective end of said barrel.

* * * * *